US010486072B1

(12) United States Patent
Blumhagen

(10) Patent No.: US 10,486,072 B1
(45) Date of Patent: Nov. 26, 2019

(54) AMUSEMENT RIDING DEVICE

(71) Applicant: Mark Conrad Blumhagen, Spokane Valley, WA (US)

(72) Inventor: Mark Conrad Blumhagen, Spokane Valley, WA (US)

( * ) Notice: Subject to any disclaimer, the term of this patent is extended or adjusted under 35 U.S.C. 154(b) by 0 days.

(21) Appl. No.: 15/732,093

(22) Filed: Sep. 18, 2017

(51) Int. Cl.
*A63G 1/48* (2006.01)
*A63K 1/00* (2006.01)

(52) U.S. Cl.
CPC ..... *A63G 1/48* (2013.01); *A63G 2200/00* (2013.01)

(58) Field of Classification Search
CPC ... A63G 1/00; A63G 1/08; A63G 1/32; A63G 3/00; A63G 3/02; A63G 25/00; A63G 1/48; A63K 1/00
USPC ..... 472/1, 3, 28–29, 40–41
See application file for complete search history.

(56) References Cited

U.S. PATENT DOCUMENTS 921,416 A * 5/1909 Lauster ..... A63G 1/00 472/1
3,459,422 A * 8/1969 Winton ..... A63G 1/08 472/1
3,492,017 A * 1/1970 Czichos ..... A63G 25/00 180/2.1
4,836,521 A * 6/1989 Barber ..... A63G 3/02 104/86
4,971,314 A * 11/1990 Barber ..... A63G 25/00 104/69
5,061,211 A * 10/1991 Barber ..... A63G 3/00 104/76
5,676,601 A * 10/1997 Saunders ..... A63G 1/32 472/107
5,716,282 A * 2/1998 Ring ..... A63G 3/00 104/70
6,045,449 A * 4/2000 Aragona ..... A63B 67/007 472/117
9,039,540 B2 * 5/2015 Kuempel ..... A63K 1/00 472/3

* cited by examiner

*Primary Examiner* — Kien T Nguyen

(57) ABSTRACT

An amusement device attached to a flat bed surface of a flatbed truck. A subfloor is hingedly attached to one end of the flat bed. A mechanical assembly such as a telescoping hydraulic rod can be extended or retracted by an operator to change the angle of the subfloor. A plurality of flat panels unfold to form a circularly shaped main floor. The floor includes a central shaft that can be activated to cause the floor to rotate. People holding carriages are round in plan view and have castor support wheels cause the carriage to slide around on the circular shaped floor as the floor both rotates and is tilted at an angle. The centrifugal force of the rotation causes the carriages to be flung outwards where the are retained by a scalloped perimeter wall attached to the circular floor.

7 Claims, 7 Drawing Sheets

AMUSEMENT RIDING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of amusement ride devices and more specifically to a portable amusement riding device that allows passengers to move in random directions as the floor of the ride tilts and rotates.

Amusement park rides have been pleasing children and adults around the world for over one hundred years. Some amusement rides have become portable and are mounted on flatbed trucks and taken from town to town to be used at various fairs and entertainment events.

Some previously invented portable amusement rides include:

U.S. Pat. No. 921,416 issued in 1906 describes an amusement device that uses circular cars or carriages that can travel down an undulating, downwardly slanting track. The cars can rock from side to side as they proceed down the track.

U.S. Pat. No. 4,836,521 issued in 1989 discloses a whirlpool amusement ride that includes floating vehicles that are lifted and then released into a circular pond that has swirling water creating a vortex.

U.S. Pat. No. 5,716,282 shows a spinning water ride apparatus that uses round floating rafts riding on a thin layer of water and where the rafts can travel down a cork screw track to an end point.

U.S. Pat. No. 6,045,449 shows a water pinball ride where riders float down an angled giant pinball field and can bump into obstacles or flippers along the way.

U.S. Pat. No. 8,210,955 discloses an amusement ride system that uses a vehicle to maneuver over a water type travel surface where the vehicle has a drive assembly that can help the vehicle maneuver along the travel surface.

Although the above patents describe amusement devices that allow people to ride small cars in unpredictable fashion down a travel path or surface, there are deficiencies in the prior technologies. First, many of the rides described would be hard to translate into a portable amusement ride that can be deployed from the bed of a truck. Second, the amusement devices do not take advantage of centrifugal motion that can add additional excitement and unpredictability to the ride. Third, the riders can not engage with other riders in a "bumper car" fashion.

BRIEF SUMMARY OF THE INVENTION

The primary object of the invention is to provide an amusement riding device that is stored on a flatbed truck or trailer and can be deployed to form an amusement ride for children or adults.

Another object of the invention is an amusement riding device that includes a plurality of hinged panels that, when unfolded, form a circular shaped floor surface for the placement of a plurality of wheeled, people carrying carriages.

Another object of the invention is an amusement riding device where the circular shaped floor is supported by a plurality of radially deployable trusses.

A further object of the invention is an amusement riding device where the circular floor can be made to rotate at varying speeds.

Yet another object of the invention is an amusement riding device where the circular floor can be made to lift or lower into an angular position in relation to the ground.

Still yet another object of the invention is an amusement riding device where the scalloped retaining walls are located at the perimeter of the circular floor so that when a circular carriage is forced to the perimeter by centrifugal force, the carriages can each be cradled by one of the matching scallops.

Another object of the invention is an amusement riding device where each carriage includes perimeter bumpers for allowing one carriage to safely bump into or against another carriage.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an amusement riding device comprising: a flatbed truck type vehicle having a substantially flat bed carrying surface, a largely rectangular subfloor panel, comprising two sides and two ends, hingedly attached to one end of said flat bed carrying surface, a mechanical assembly comprising means of lifting the end of said subfloor panel opposite of the end hingedly attached to the said subfloor panel, a circular sleeve surrounding a central shaft, the said shaft perpendicularly attached to said subfloor panel, a plurality of support trusses, each comprising two ends, wherein the end proximal to the said circular sleeve is hingedly attached to the said circular sleeve surrounding the central shaft, a plurality of flat panels hingedly attached to each other, that when unfolded form a substantially circular floor surface, said circular floor surface comprising a scalloped perimeter wall, said circular floor surface caused to lay flat upon the said trusses when unfolded, said circular floor surface capable of rotating about the said central shaft, a plurality of people-holding carriages each having a substantially circular shape when viewed from above, each carriage comprising a plurality of caster type wheels supporting the said carriages, said wheels providing means for the carriages to randomly roll across said flat floor surface when said floor surface is tilted by said mechanical assembly, said carriages each capable of temporarily seating themselves within said scalloped area of said perimeter wall when moved to the perimeter by a centrifugal force caused by rotation of said floor surface, and said carriages each having a resilient perimeter bumper allowing said carriages to safely bump into each other, or into the said bumpers, or into the said perimeter wall.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
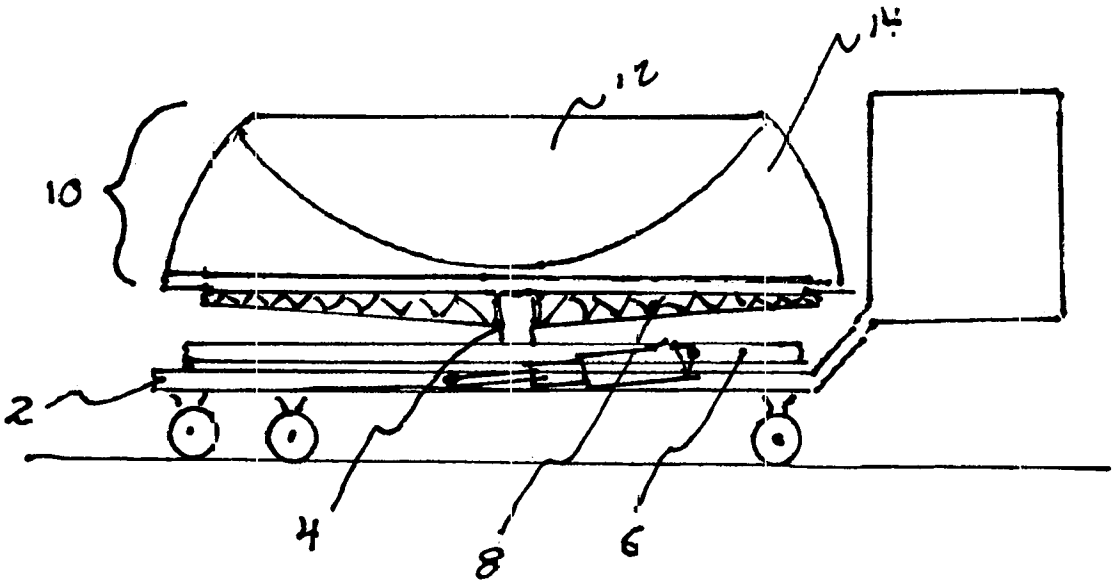
FIG. 1 is a side view of the invention mounted to the flat bed of a truck.
Figure 5:
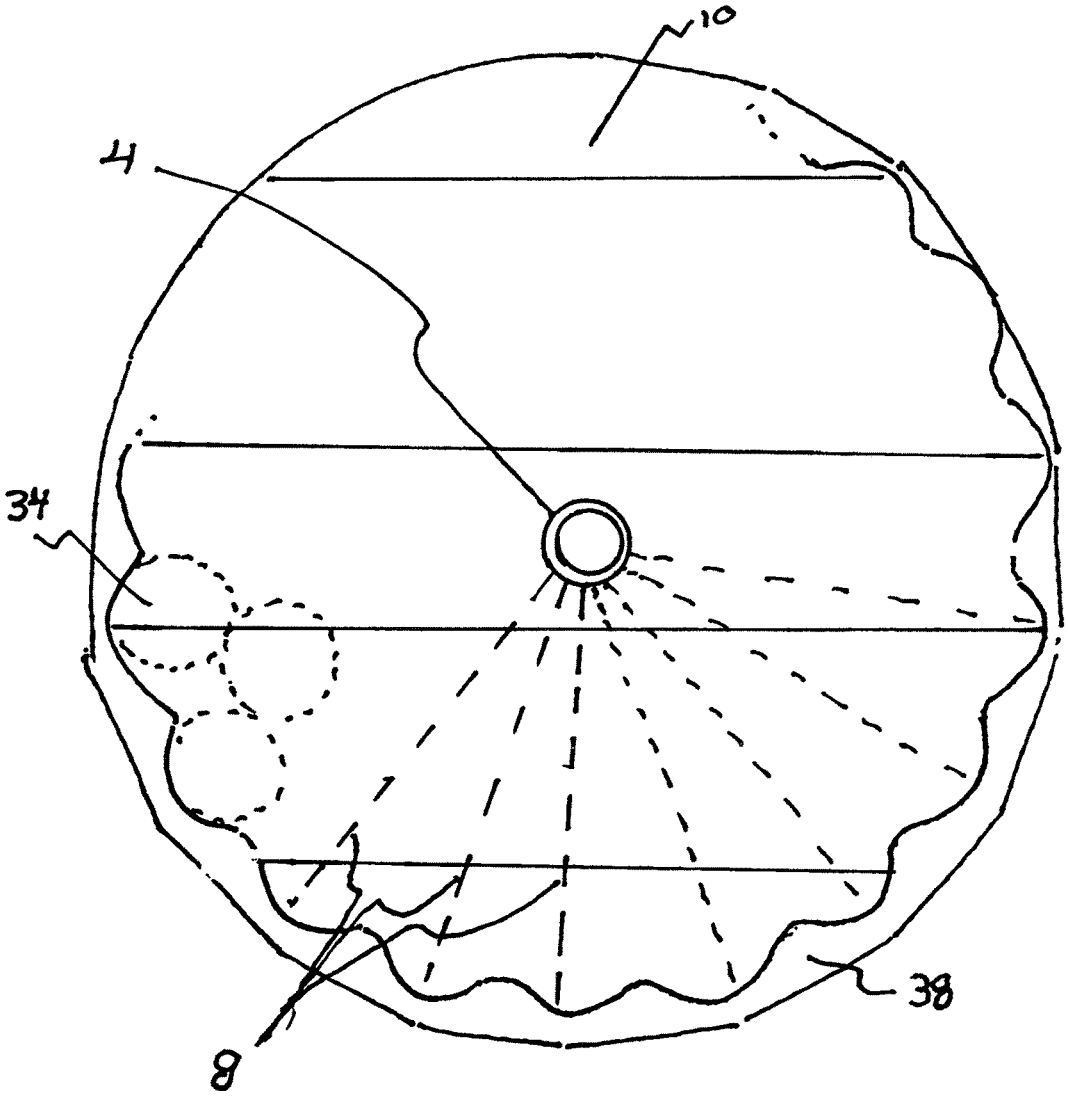
FIG. 5 is a plan view of the circular floor.

Referring now to FIG. 1 we see a side view of the invention sitting on the flat surface of a flatbed 2 truck. A substantially circular floor 10 consisting of a plurality of hinged panels 12, 14 are folded up for transport. A centrally located sleeve 4 has a plurality of support trusses 8 hingedly attached to it. The trusses 8 can be rotated out to form a circular pattern as shown in the plan view in FIG. 5.

Sleeve 4 is mounted on subfloor 8.

Figure 2:
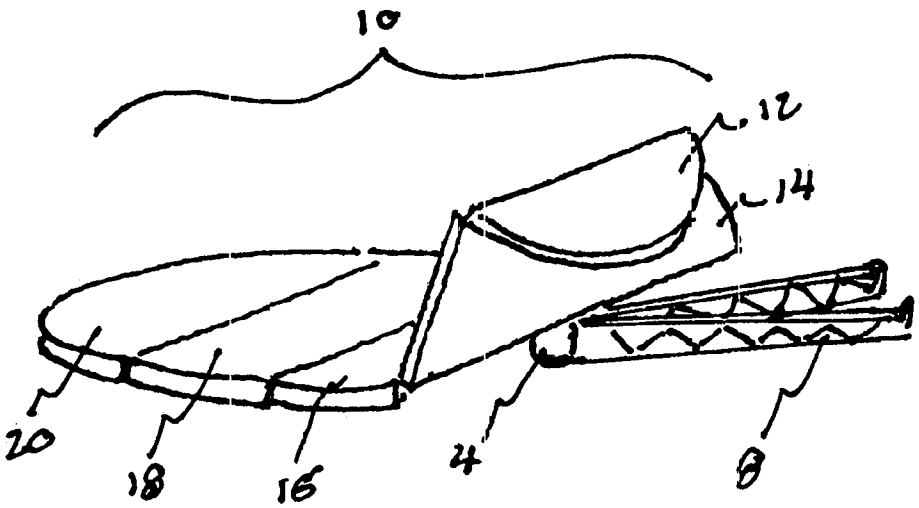
FIG. 2 is a perspective view of the circular floor being deployed.

FIG. 2 is a perspective view of the circular floor 10 being deployed and laying down on trusses 8. The floor is comprised of a plurality of rigid panels 12, 14, 16, 18,20 that are hinged to each other.

Figure 3:
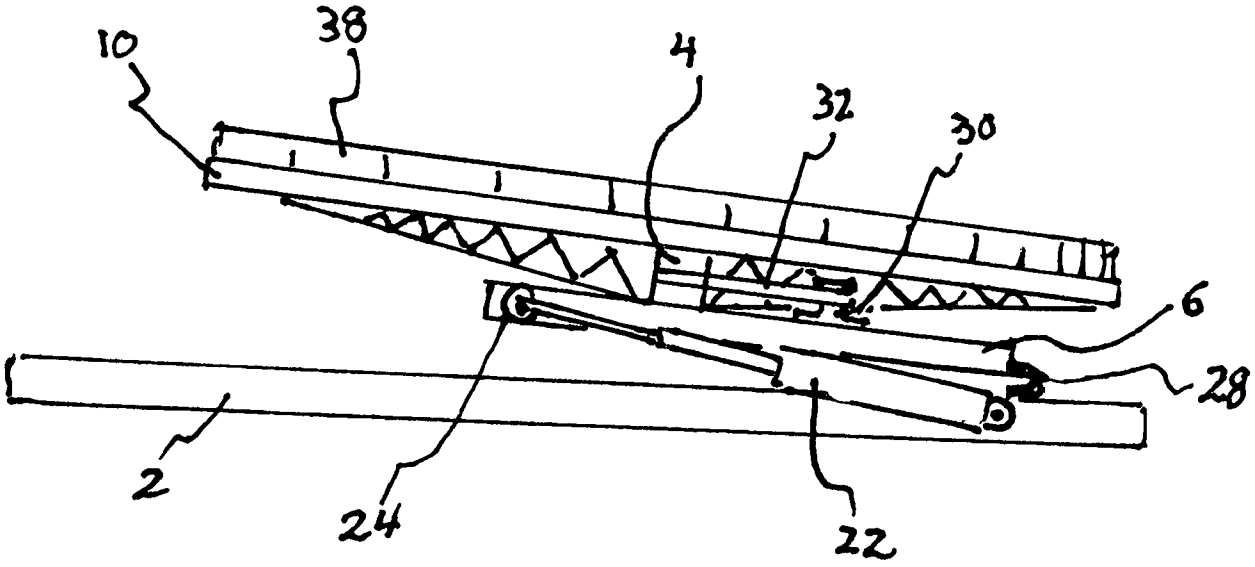
FIG. 3 is a side view of the tilting mechanism for tilting the circular floor.

FIG. 3 is a side view of the invention showing how subfloor 6 is hinged at location 28. A mechanical lifting assembly 22 shown here as a telescoping hydraulic assembly is pinned at one end to pivot point 26 and at the other end to point 24 located on the side of subfloor 6. When the telescoping hydraulic assembly 22 is extended, it causes subfloor 6 and attached floor 10 to tilt from a horizontal plane to an angled plane of as much as ten percent. Motor 30 and belt 32 engage rotatable sleeve 22 enabling the circular floor 10 to rotate. The speed of the rotation can be adjusted by the ride operator.

Figure 4:
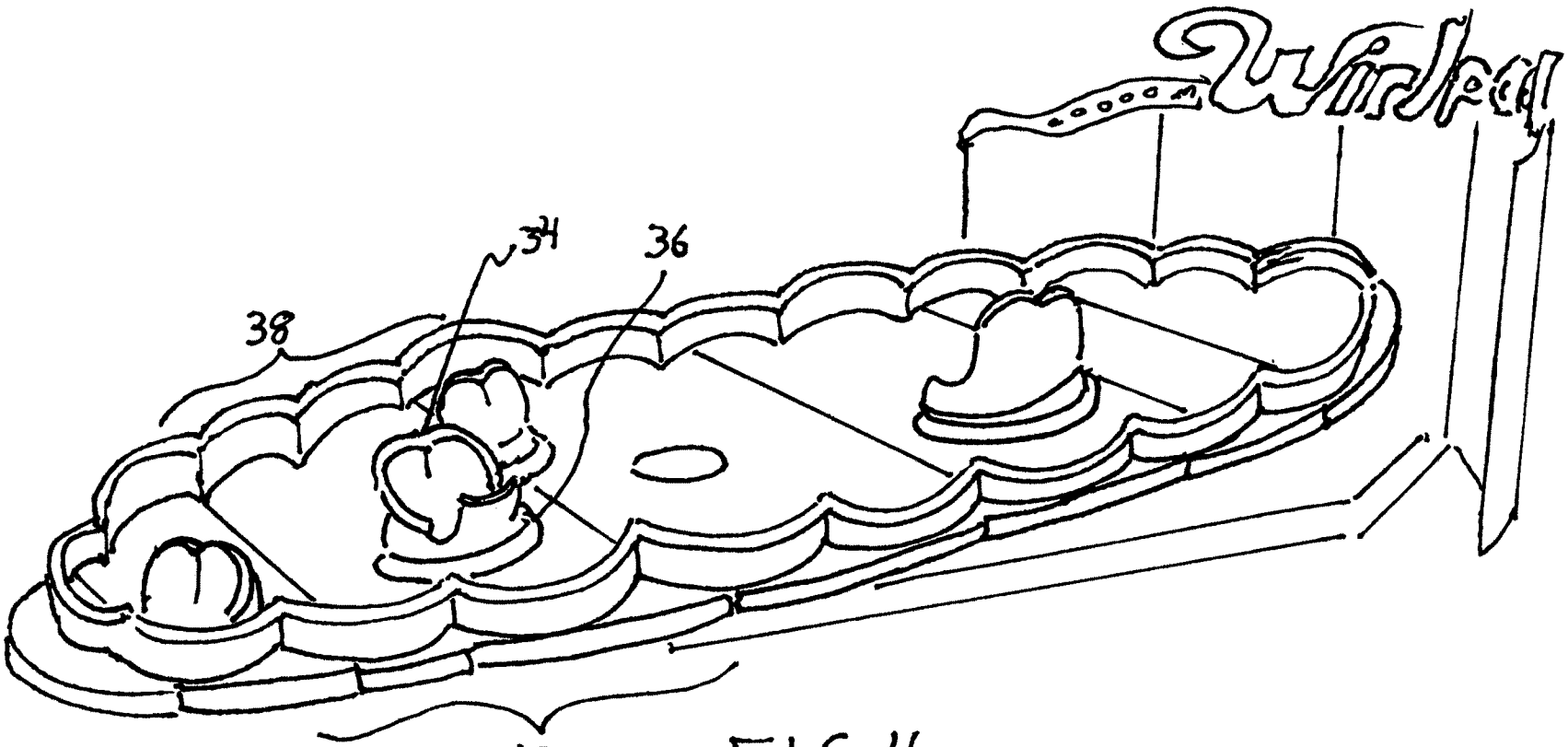
FIG. 4 is a perspective view of the amusement ride device fully deployed.

FIG. 4 is a perspective view of the invention in use. The circular floor 10 is fully deployed. The floor 10 is surrounded by a scalloped perimeter 38. Carriages 34 can hold one or more people and have caster type wheels under them allowing them to roll freely in random directions as the floor 10 is rotated and lifted to an angle. The carriages 34 are round in plan view and each carriage has a resilient bumper 36 at their perimeter so that one carriage 34 may safely bump into another carriage 34. The scallops in the perimeter wall 38 are sized to cradle a carriage 34 when the carriage 34 moves to the perimeter due to the centrifugal force generated by the rotation of circular floor 10.

In one embodiment, the floor 10 has a grid of strips of positive and negative floor panels that, when energized, act as a low voltage electromagnetic brake to stop the carriages 34 that have ferrous metal plates under their chassis. This configuration can help the operator stop the carriages when ride is completed.

Figure 6:
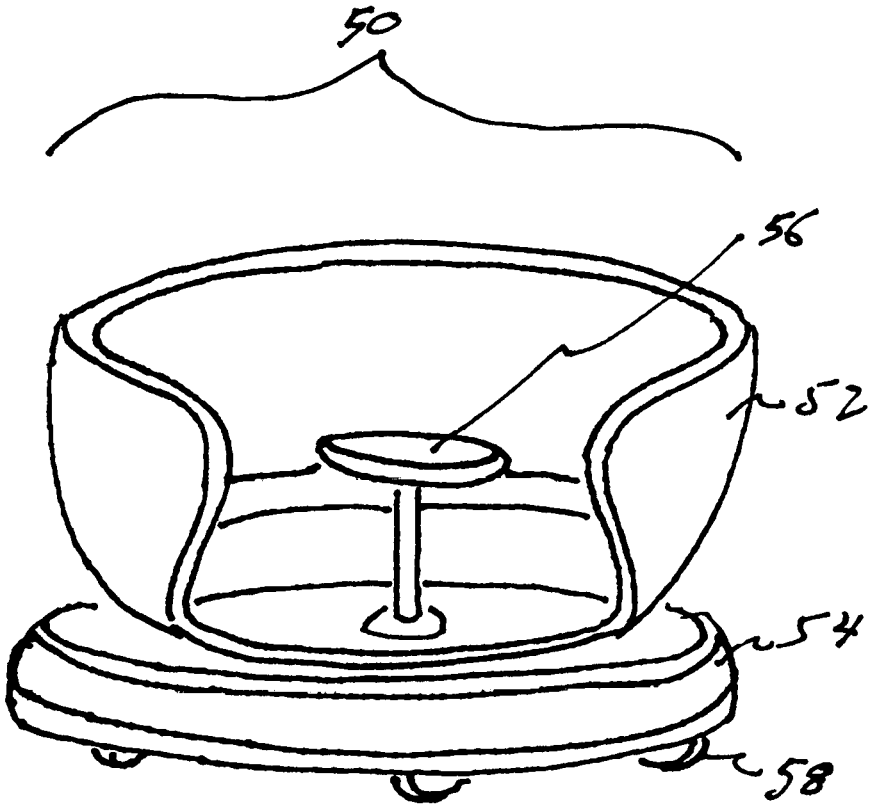
FIG. 6 is a perspective view of a carriage having a swivel seat feature.

FIG. 6 is a perspective view of one embodiment of a carriage 50 where a person can turn a centrally located wheel 56 to spin the carriage during operation, the main carriage 50 has a circular shape 52. A resilient bumper 54 acts to soften the collision between two carriages. The wheels 58 can swivel in any direction.

Figure 7:
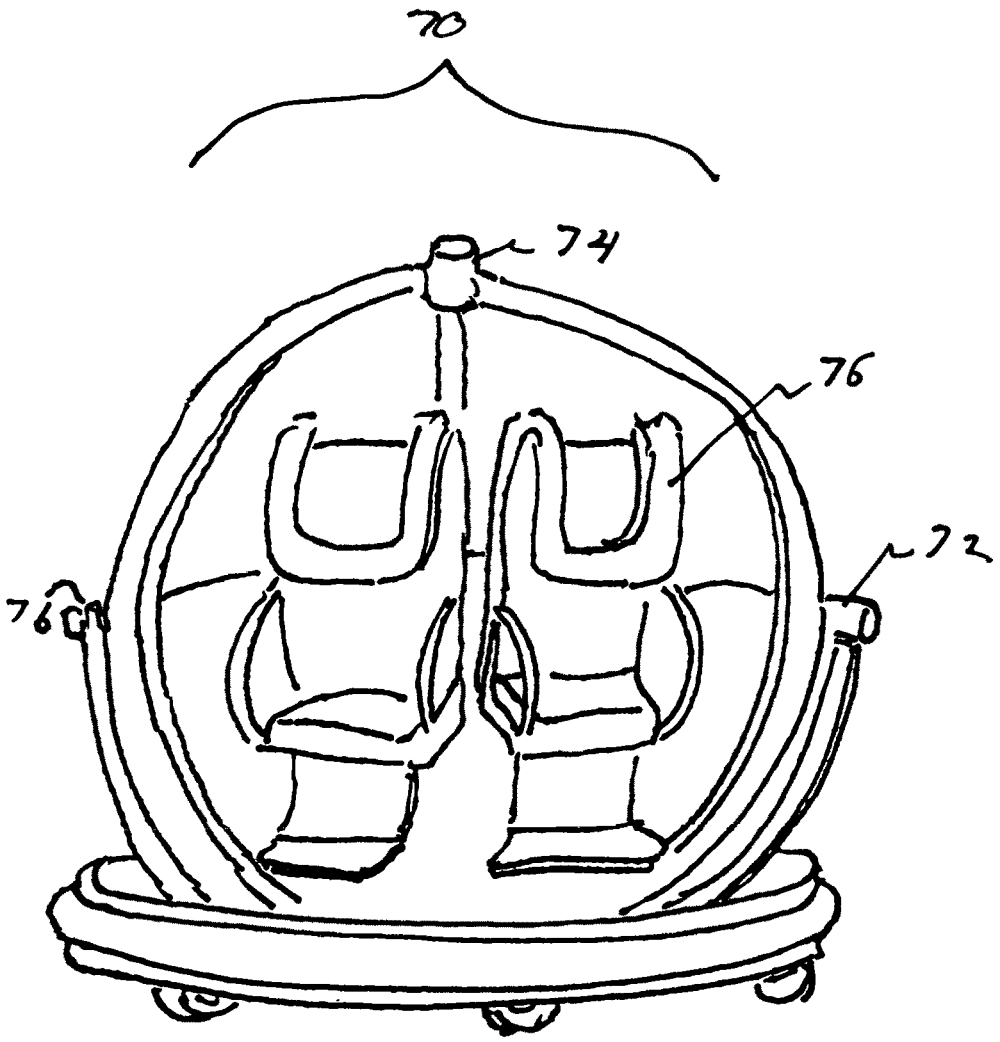
FIG. 7 is a perspective view of a carriage having a double gimbaled frame.

FIG. 7 is a perspective view of another embodiment of a carriage 70 that has a double gimbaled feature created by swivel points 72, 76 on the horizontal plane and swivel point 74 on the vertical plane. This enables the seat portion 76 to rotate in all directions as the carriage 70 slides around on the floor 10.

The operation of the ride is as follows:

Passengers go up a ramp on the circular giant level floor 10 with a plurality of carriages 34. Patrons are seated and when restraints are in place, the floor 10 begins to revolve. At this point the cars roll to the outside edge scallop-shaped perimeter wall 38. The indentations in the wall 38 accommodate the circular shape of the cars. The floor platform 10 begins to tip, as high as 10 degrees and the carriages, which are still loose, roll to the bottom by gravity. The ones on the edge are pulled toward the top and roll out of the scalloped grooves when gravity takes over and begin an unpredictable hap-hazard random journey to the bottom, spinning and bumping off fixed bumper posts on the floor and off other carriages. The faster the platform spins, the higher they are carried before being "released". The faster speed also creates an arc trajectory from the perimeter before gravity prevails over velocity.

The platform floor 10 eventually lowers and the ride comes to a stop. The carriages, when level, are reasonably inert and are stable enough that the passengers can disembark safely.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An amusement riding device comprising:

a flatbed truck type vehicle having a relatively flat bed carrying surface;

a subfloor panel hingedly attached to one end of said flatbed carrying surface;

a mechanical assembly capable of lifting one end of said subfloor panel and comprising:

a circular sleeve surrounding a central shaft perpendicularly attached to said subfloor panel;

a plurality of support trusses, each having an end proximal to the said circular sleeve, wherein each truss is hingedly attached to the said circular sleeve at the proximal end of the said truss;

a plurality of flat panels hinged to each other that when unfolded form a substantially circular floor surface;

said circular floor surface including a scalloped perimeter wall;

said circular floor surface caused to lay flat upon said trusses;

said circular floor surface capable of rotating about said central shaft;

a plurality of people-holding carriages each having a circular shape when viewed from above;

each carriage supported by a plurality of caster type wheels;

said carriages capable of rolling across said flat floor surface when said floor surface is tilted by said mechanical assembly;

said carriages each capable of temporarily seating themselves within said scalloped area of said perimeter wall when said floor surface is rotated causing a centrifugal force; and said carriages each having a resilient perimeter bumper allowing one carriage to safely bump into another carriage.

2. An amusement riding device as claimed in claim 1 wherein said floor surface including one or more perpendicularly and upwardly oriented post;

said carriages capable of colliding with said posts when said carriages are being moved by said angular and rotational motions.

3. An amusement riding device as claimed in claim 1 wherein said mechanical assembly includes a hydraulic telescoping arm B capable of extending or retracting by actuation of an operator.

4. An amusement riding device as claimed in claim 1 wherein said circular floor surface is supported by a plurality of wheels located on the underside of said floor surface and making contact with the top surface of said subfloor panel and capable of supporting said floor surface as it is rotated about said central shaft.

5. An amusement riding device as claimed in claim 1 wherein the top side of said circular floor surface includes a plurality of metallic floor electrically charged panels that when energized act as a low voltage electromagnetic brake by reacting to a ferrous metal surface located under said people-holding carriages.

6. An amusement riding device as claimed in claim 1 wherein the carriage includes a central steering wheel that allows a rider to swivel the seats located on the carriage.

7. An amusement riding device as claimed in claim 1 wherein another embodiment of the carriage includes both horizontal and vertical gimbals to allow the seats to rotate in all directions while sliding on the said floor.

* * * * *